US009394864B2

(12) United States Patent
Arteaga et al.

(10) Patent No.: US 9,394,864 B2
(45) Date of Patent: Jul. 19, 2016

(54) MULTI-FREQUENCY QUARTER-WAVE RESONATOR FOR AN INTERNAL COMBUSTION ENGINE VEHICLE

(71) Applicant: Ford Global Technologies, LLC, Dearborn, MI (US)

(72) Inventors: Jose Arteaga, Dearborn, MI (US); Suman Mishra, Dearborn, MI (US); Lloyd Anthony Bozzi, Saline, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 14/301,920

(22) Filed: Jun. 11, 2014

(65) Prior Publication Data

US 2015/0361934 A1 Dec. 17, 2015

(51) Int. Cl.

| | |
|---|---|
| ***F02M 35/16*** | (2006.01) |
| ***F01N 1/02*** | (2006.01) |
| ***F02M 35/12*** | (2006.01) |
| *F01N 1/00* | (2006.01) |

(52) U.S. Cl.

CPC ..... *F02M 35/1261* (2013.01); *F02M 35/1222* (2013.01); *F02M 35/1294* (2013.01)

(58) Field of Classification Search

CPC ..... F01N 1/02; F01N 1/16; F01N 1/161; F01N 1/163; F02M 35/12; F02M 35/1222; F02M 35/1261; F02M 35/1255

USPC ..... 181/229, 250, 254, 237, 241; 123/184.53, 184.57, 184.55; 267/166, 267/166.1, 174, 70, 69, 71; 137/628, 613, 137/614.11, 614.19

See application file for complete search history.

(56) References Cited

U.S. PATENT DOCUMENTS

| | | | | | |
|---|---|---|---|---|---|
| 1,173,583 | A * | 2/1916 | Johnston | 181/254 |
| 1,375,621 | A * | 4/1921 | Wright, Jr. | 181/236 |
| 2,404,589 | A * | 7/1946 | Monaghan | 181/232 |
| 3,620,330 | A * | 11/1971 | Hall | 181/266 |
| 4,484,659 | A * | 11/1984 | Buchwalder | 181/266 |
| 4,562,809 | A * | 1/1986 | Sausner et al. | 123/339.27 |
| 5,137,439 | A * | 8/1992 | Lundin | 418/181 |
| 5,246,205 | A * | 9/1993 | Gillingham et al. | 251/334 |
| 5,317,112 | A * | 5/1994 | Lee | 181/250 |
| 5,333,576 | A * | 8/1994 | Verkleeren | 123/184.53 |
| 5,435,347 | A * | 7/1995 | Gillingham | 137/599.09 |
| 7,779,962 | B2 * | 8/2010 | Zhang | 181/237 |
| 2002/0005318 | A1 * | 1/2002 | Schumacher et al. | 181/237 |
| 2009/0229913 | A1 * | 9/2009 | Tonietto et al. | 181/254 |
| 2014/0316325 | A1 * | 10/2014 | Jaber | 604/9 |

FOREIGN PATENT DOCUMENTS

| | | | | |
|---|---|---|---|---|
| JP | 02215925 | A * | 8/1990 | F02B 27/02 |
| JP | 2006308257 | A * | 11/2006 | |
| WO | 2004094826 | A1 | 11/2004 | |

* cited by examiner

*Primary Examiner* — Edgardo San Martin

(74) *Attorney, Agent, or Firm* — Greg P. Brown; Brooks Kushman P.C.

(57) ABSTRACT

A variable noise attenuation element is disclosed that comprises a tube, at least one valve seat, at least one valve body and a wire connected to the valve body. The tube has an overall length that defines a first effective length for noise attenuation. The valve seat is disposed in the tube. Retraction of the wire brings the valve body into engagement with the valve seat to selectively define a second effective length of the tube that is less than the overall length.

17 Claims, 6 Drawing Sheets

MULTI-FREQUENCY QUARTER-WAVE RESONATOR FOR AN INTERNAL COMBUSTION ENGINE VEHICLE

TECHNICAL FIELD

The present disclosure is directed to a noise attenuation device and more particularly to a noise attenuation device that may be having an effective length selectively varied.

BACKGROUND

Internal combustion engines produce undesirable induction noise within a vehicle. While the induction noise is dependent on the particular engine configuration and other induction system parameters, such noise is caused by a pressure wave that travels toward the inlet of the air induction system. Induction noise is particularly problematic in hybrid vehicles, as changes in ambient noise are particularly noticeable, particularly because engines in hybrid vehicles repeatedly turn on and off. Moreover, hybrids tend to operate a specific engine RPMs that maximize efficiency since the engine speed is not directly related to vehicle speed and can be varied by changing the generator speed (depending on the powertrain architecture).

To address such noise, it is known to utilize exhaust mufflers to reduce engine exhaust noise, as well as smooth exhaust-gas pulsations. Some known mufflers include a series of fixed expansion or resonance chambers of varying lengths, connected together by pipes. With this configuration, the exhaust noise reduction is achieved by the size and shape for the individual fixed expansion chambers. While increasing the number of channels can further reduce exhaust noise, such configurations require additional packaging room within the vehicle, limiting design options for various components. Further, while mufflers traditionally include sound deadening material, such material only dampens sounds over a broad band of higher frequencies.

Another proposed solution for addressing undesirable noise is use of a Helmholz resonator or a quarter-wave resonator. These resonators produce a pressure wave that counteracts primary engine order noise waves. Such resonators consist of a fixed volume chamber connected to an induction system duct by a connection or neck. However, such arrangements attenuate noise only at a fixed narrow frequency range.

However, the frequency associated with the primary order of engine noise is different at different operating levels. Thus a fixed geometry resonator would be ineffective in attenuating primary order noise over much of the complete range of engine speeds encountered during normal operation of a vehicle powered by the engine. Moreover, such conventional resonator systems provide an attenuation profile that does not match the profile of the noise and yields unwanted accompanying side band amplification. This is particularly true for a wide band noise peak. The result is that when a peak value is reduced to the noise level target line at a given engine speed, the amplitudes of noise at adjacent speeds are higher than the target line. While multiple resonators could be used to address different frequencies, such a solution requires additional packaging room within a vehicle.

While not as common as the passive devices described above, active noise cancellation systems have also been employed in vehicle exhaust systems. Active noise cancellation systems include one or more vibrating panels (i.e., speakers) that are driven by a microprocessor. The microprocessor monitors the engine operation and/or the acoustic frequencies propagating in the exhaust pipe and activates the panels to generate sound that is out-of-phase with the noise generated by the engine to minimize or cancel engine noise. The principle is similar to that used by noise-canceling headphones. However, active devices have significant drawbacks. Some active devices are positioned within a cab of a vehicle and thus require sufficient packaging room for positioning, while maintaining an aesthetics. Other active devices have been placed in the automotive exhaust systems. However, in these arrangements, the microphones and speakers must be more powerful and capable of withstanding the intense heat and corrosive environment of an automobile exhaust. Furthermore, active devices are often cost-prohibitive for many vehicles.

A noise attenuation device that is capable of variable frequency noise reduction is needed.

SUMMARY

In a first exemplary arrangement, a variable noise attenuation element is provided that comprises a tube, at least one valve seat, at least one valve body and a wire connected to the valve body. The tube has an overall length that defines a first effective length for noise attenuation. The valve seat is disposed in the tube. Retraction of the wire brings the valve body into engagement with the valve seat to selectively define a second effective length of the tube that is less than the overall length.

In a second exemplary arrangement, a variable noise attenuation element is provided that comprises a tube having an overall length that defines a first effective length, first and second valve seats, first and second valve bodies that are selectively engageable with the first and second valve seats, respectively, and a wire. The first and second valve seats are at fixed positions within the tube. The wire is connected to the first and second valve bodies. A first spring is disposed between an end of the wire and the first valve body. A second spring is disposed between the first valve seat and the second valve body. An initial retraction of the wire serves to deflect the first spring and selectively bring the first valve body into engagement with the first valve seat, to selectively define a second effective length of the tube that is less than the first effective length. Continued retraction of the wire will bring the second valve body into engagement with the second valve seat, to selectively define a third effective length of the tube that is less than the second effective length.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

The present disclosure is directed to a noise attenuation element that utilizes a quarter-wave tube for noise attenuation. A first end of the quarter-wave tube is open and in fluid communication with an air intake passage or the like, while the second end is generally closed. Typically, the quarter-wave tube will attenuate noise at a given frequency range, due to its fixed geometry. However, lengthening or shortening the length of the quarter-wave tube can serve to attenuate noise at a lower or higher frequency range, respectively. Arrangements of a quarter-wave tube disclosed herein, whereby the quarter-wave tube itself has a fixed overall length, are provided with multiple effective lengths by one or more valve arrangements mounted within the quarter-wave tube. This configuration provides for a noise attenuation element that can be tuned to several different frequencies, but only requires packaging space within a vehicle for a single resonator.

Figure 1:
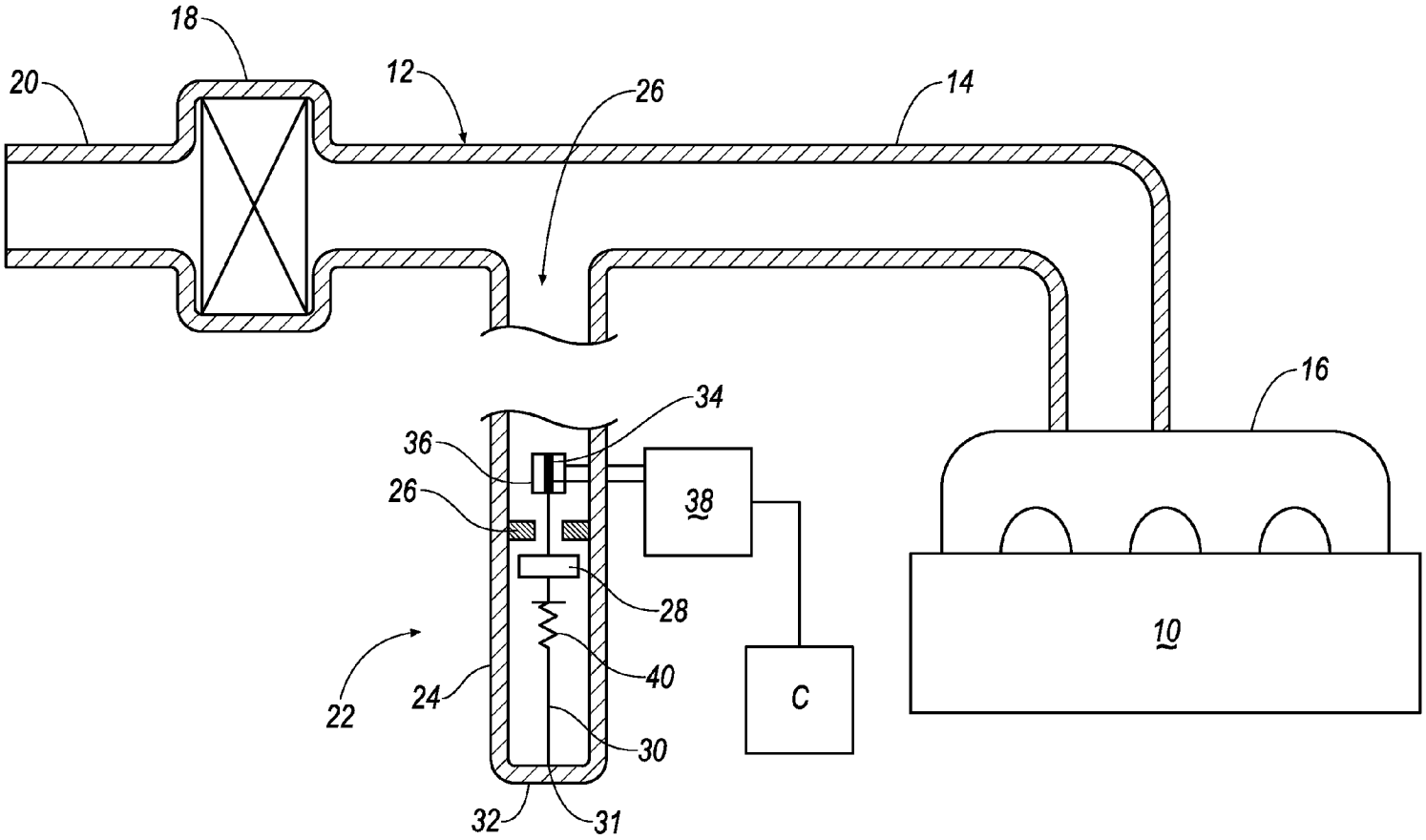
FIG. 1 is a sectional view of an exemplary air induction system for an internal combustion engine, comprising a first exemplary arrangement of a noise attenuation element.

Referring to FIG. 1, an internal combustion engine 10 and an associated air induction system 12 are illustrated. The air induction system 12 comprises an intake passage 14 that is in communication with an engine intake manifold 16. An air cleaner 18 may be in fluid communication with the atmosphere via an intake passage 20. In one exemplary arrangement, a noise attenuation element 22 extends from the air intake passage 14, between the air cleaner 18 and the engine intake manifold 16. Alternatively, the noise attenuation element 22 may be located upstream of the air cleaner 18.

Figure 2:
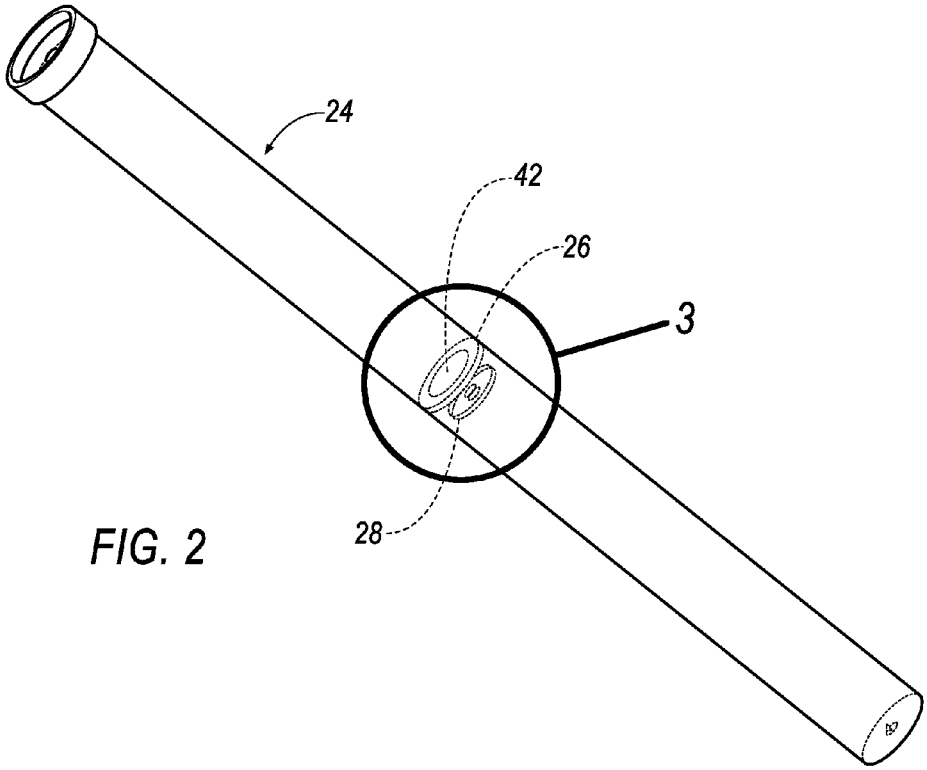
FIG. 2 is a perspective cross-sectional view of the noise attenuation element of FIG.
Figure 3:
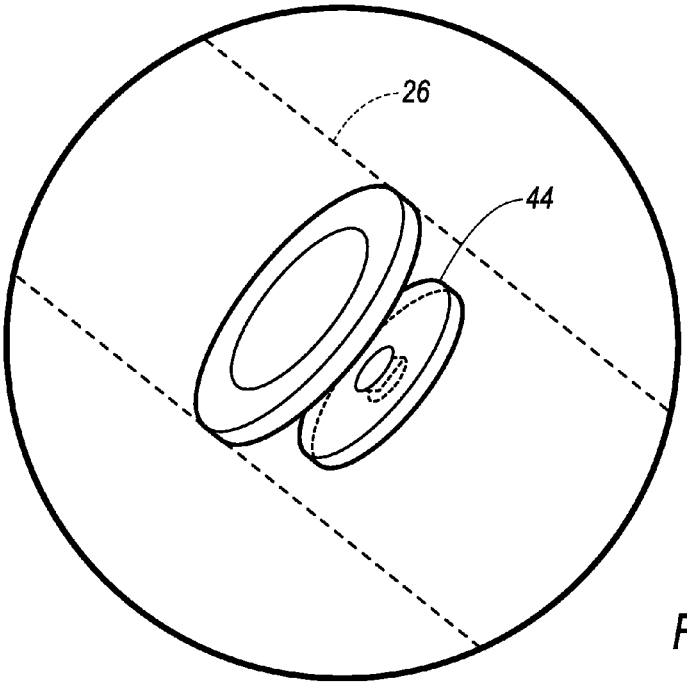
FIG. 3 is an enlarged perspective view of area 3 of FIG. 2, illustrating a valve disposed in the noise attenuation element in a first open position.

The noise attenuation element 22 comprises a quarter-wave tube 24 having an open end 25 that is in communication with the air intake passage 14. At least one valve seat 26 is disposed within the quarter-wave tube 24, at a predetermined location, as best seen in FIG. 2. At least one valve body 28 (as best seen in FIG. 3) is operatively connected to a wire or cable 30. A wire 30 has one end 31 that is fixed to a closed end 32 of the quarter-wave tube 24. A second end 34 is fixed to a take-up mechanism 36 that is positioned above the valve seat 26. In one exemplary arrangement, the take-up mechanism 36 is a winding member. The take-up mechanism 36 is operatively connected to a motor 38 that controls a retraction action of take-up mechanism 36. The motor 38 is operatively connected to a controller that activates or deactivates the motor, based on certain operational parameters, as will be explained in further detail below. A spring 40, having a predetermined spring constant, may be disposed between end 31 of the wire 30 and the valve body 28. In one exemplary arrangement, the spring 40 may be integrally connected the wire 30. Alternatively, the noise attenuation element 22 may be comprised of separate wire sections that are connected together by the spring 40.

Referring to FIGS. 2 and 3, additional details of the valve seat 26 and valve body 28 may be seen. For ease of illustration, wire 30, take-up mechanism 36, and spring 40 have been omitted. Valve seat 26 is fixedly secured to an interior wall of the quarter-wave tube 24. Valve seat 26 is defined by an outer circumferential flange having an opening 42 centrally disposed therein.

The valve body 28 is sized to define an outer periphery that is larger than the opening 42 of the valve seat 26. In one exemplary arrangement, the valve body 28 is configured as a disc such that when the valve body 28 abuts the valve seat 26, the opening 42 is sealed. The valve body 28 is configured to be smaller than an inner diameter of the quarter-wave tube 24 so that valve body 28 may move easily within the quarter-wave tube 24, without frictional interference from the interior wall thereof. The valve body 28 further includes a small opening 44 (best seen in FIG. 3) that receives the wire 30. Wire 30 is fixedly secured to valve body 28 such that a predetermined tension applied to the wire 30 will serve to move the valve body 28 toward the valve seat 26. A suitable connecting mechanism (not shown) serves to retain the wire 30 to the valve body 28. For those arrangements including the spring 40 the motor 38 must apply a sufficient force to deflect the spring 40, as the wire 30 is being retracted by the take-up mechanism 36, to move the valve body 28.

In operation, with the engine 10 either not operating, or operating at a low operational condition (for example, idling), the take-up mechanism 36 is configured to be deactivated, such that the wire 30 and the spring 40, will serve to bias the valve body 28 away from the valve seat 26. In this manner, the overall length of the quarter-wave tube 24 is equal to a first effective length of the quarter-wave tube 24. At the first effective length, the noise attenuation element 22 will attenuate noise at a first predetermined frequency level. It will be appreciated that the first predetermined frequency level can be determined based on the known geometry of the quarter-wave tube 24.

When the engine 10 operational conditions change that trigger a change in noise frequency level above a threshold level, one or more signals received by the controller C will cause the motor 38 to activate the take-up mechanism 36. As one example, if the engine 10 reaches a preset speed, the controller C will signal the motor 38. In this manner, the wire 30 will be retracted by the take-up mechanism 36. Because the first end 31 of the wire 30 is fixedly connected to the closed end 32 of the quarter-wave tube 24, continued operation of the take-up mechanism 36 will take-up the slack in the wire 30, thereby moving the valve body 28 into engagement with the valve seat 26. For those exemplary arrangements including a spring 40, the take-up mechanism 36 retracts the wire 30, working against the biasing force of the spring 40, whereby the valve body 28 is biased away from the from the valve seat 26.

Once the wire 30 reaches a certain tension, the spring 40 will deflect and allow the valve body 28 to move into engagement with the valve seat 26. Once the valve body 28 is engaged with the valve seat 26, a second effective length of the quarter-wave tube 24 is achieved. The second effective length is less than the first effective length. Thus, at the second effective length, the quarter-wave tube 24 will attenuate noise at a second predetermined frequency level. Because the second effective length is less than the first effective length, the second predetermined frequency will be a higher frequency than the first predetermined frequency. The noise attenuation device 22 therefore may be selectively controlled to attenuate at variable frequencies, but only using a single quarter-wave tube 24. This configuration permits packaging a low frequency long quarter-wave tube, but providing the ability to selectively tune the quarter-wave tube to attenuate higher frequencies by reducing the effective length, without any need for additional packaging space.

Figure 4:
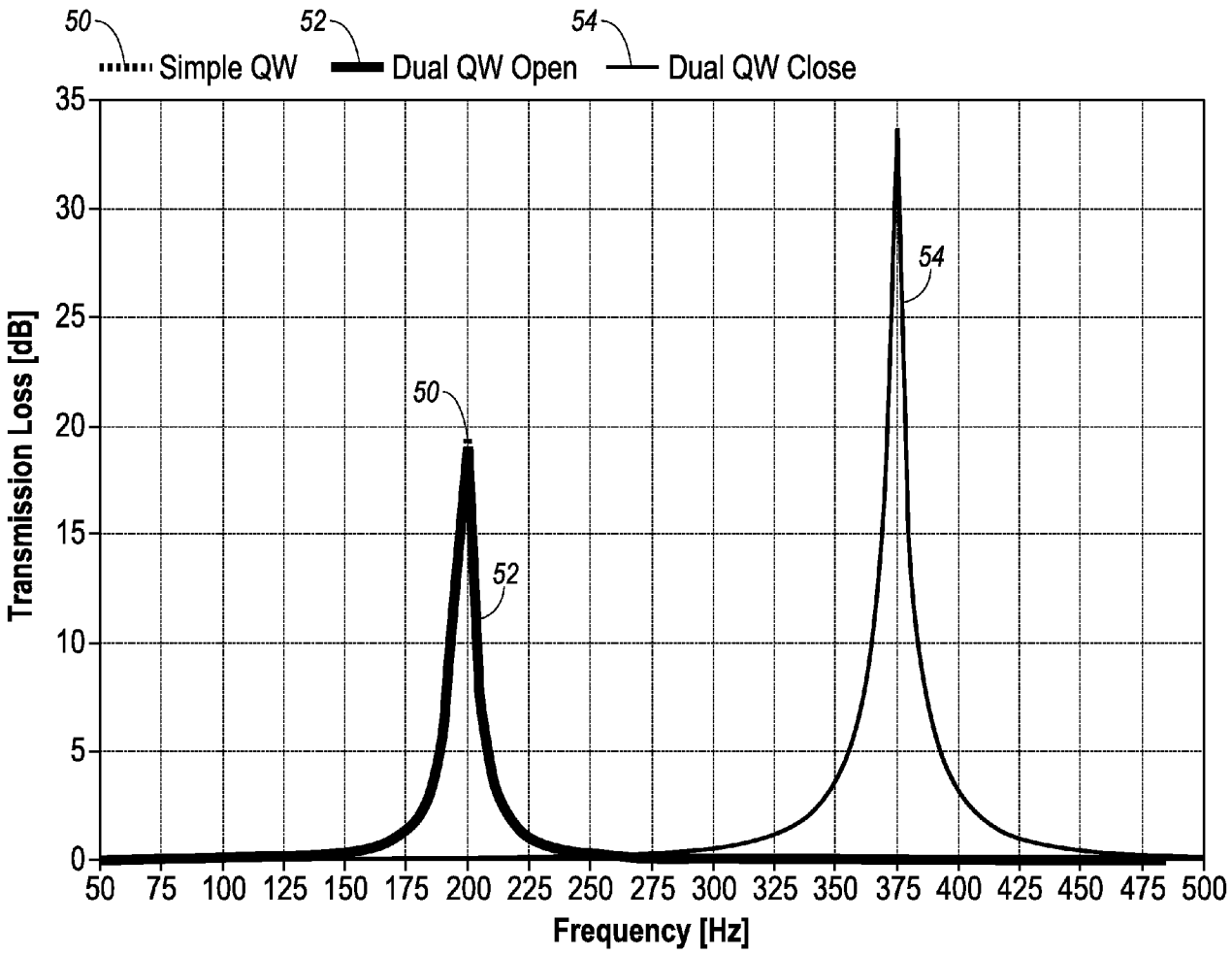
FIG. 4 is a graph illustrating the frequencies that may be achieved by the noise attenuation element of FIG. 2.

FIG. 4 graphically illustrates the effectiveness of an embodiment of the noise attenuation device 22 as compared to a simple quarter-wave tube. For example, curve 50 illustrates the performance of a noise attenuation device configured as a simple quarter-wave tube, with no valve arrangement therein. At an approximately 200 Hz frequency, the simple quarter-wave tube will attenuate approximately 19 dB of noise.

The noise attenuation device 22 is represented by lines 52 and 54 in FIG. 4. More specifically, line 52 represents the performance of the noise attenuation device 22 with the valve body 28 biased away from the valve seat 26. Line 52 has generally the same magnitude as the line 50, representing the simple quarter-wave tube. However, line 54 illustrates that when the valve body 28 engages against the valve seat 26, at a much higher frequency of approximately 375 Hz, the attenuation of noise reaches approximately 34 dB.

Figure 5:
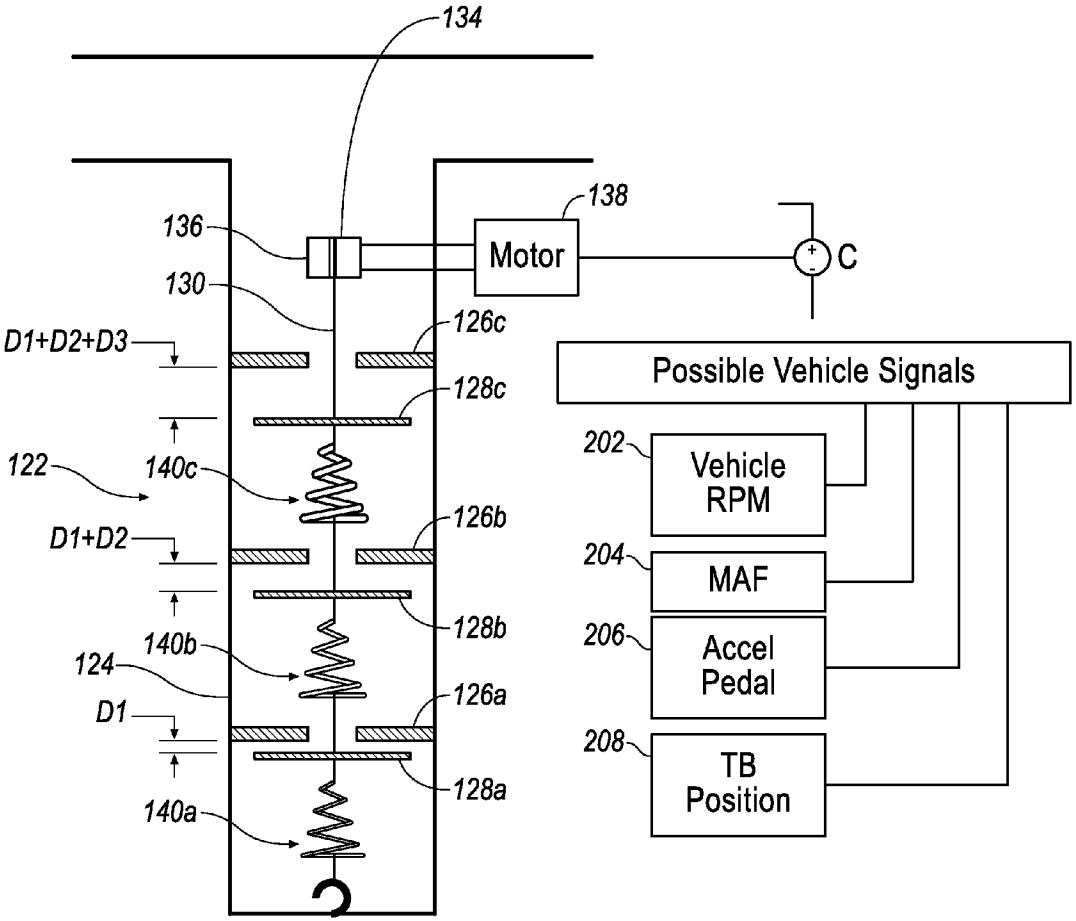
FIG. 5 is a schematic sectional view of an air induction system for an internal combustion engine, comprising a second exemplary arrangement of a noise attenuation element, wherein the noise attenuation element is operably connected to a controller.

Referring to FIG. 5, an additional arrangement of a noise attenuation device 122 is illustrated. Noise attenuation device 122 is similar to noise attenuation device 22 except that noise attenuation device 122 includes two or more springs and two or more valve seat/valve body arrangements. With this arrangement, more than 2 frequencies may be attenuated using a single quarter-wave tube 124.

In one exemplary arrangement, noise attenuation device 122 comprises a first valve body 128*a* that selectively engages a first valve seat 126*a*, a second valve body 128*b* that selectively engages a second valve seat 126*b* and a third valve body 128*c* that selectively engages a third valve seat 126*c*. The valve bodies 128*a*, 128*b*, and 128*c* are all operatively connected to a wire 130. A first end 131 of wire 130 is fixedly connected to a closed end 132 of the quarter-wave tube 124. A second end 134 is fixedly connected to a take-up mechanism 136. The take-up mechanism 136 is operatively connected to a motor 138 that controls the retraction action of the take-up mechanism 136.

Figures 6A, 6B, 6C, 6D:
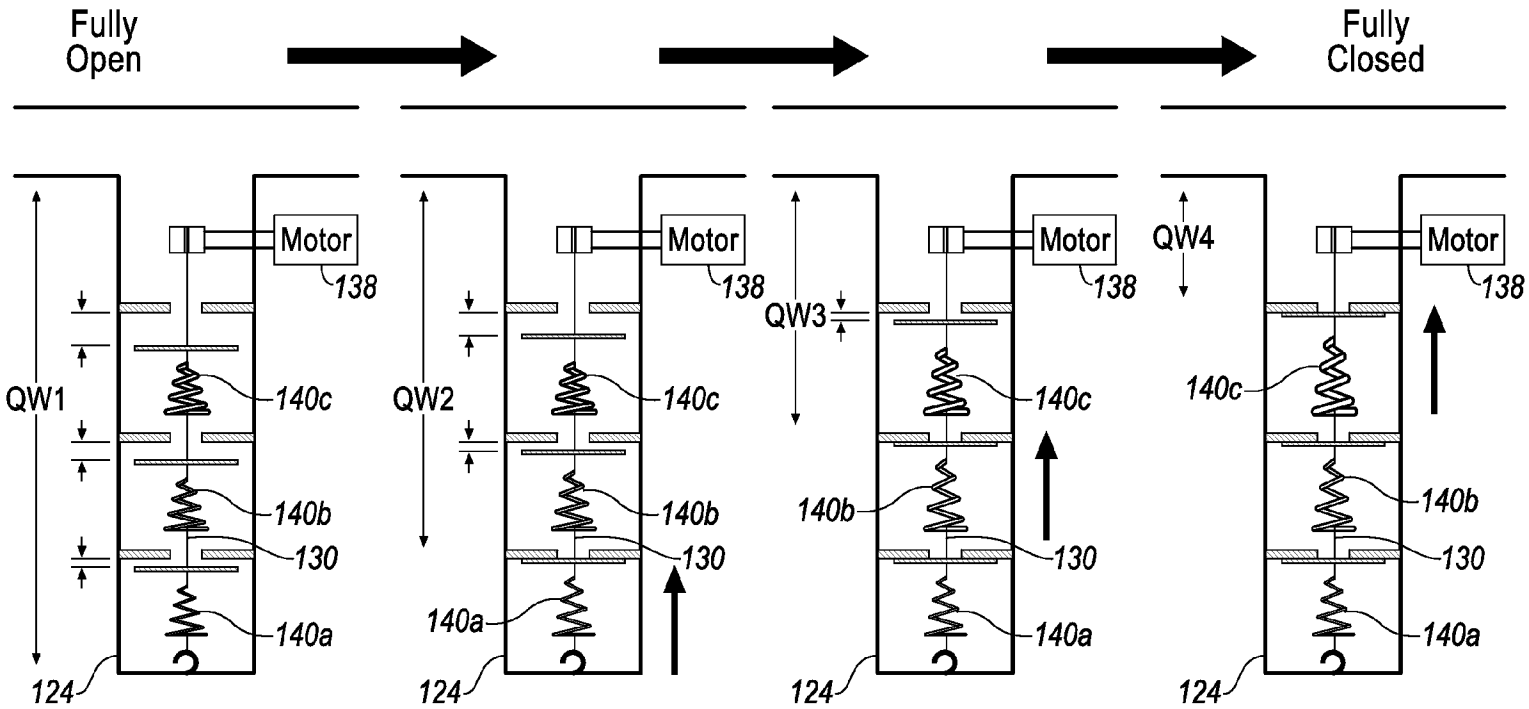
FIGS. 6A-6D is a schematic sectional view of the noise attenuation element at various possible positions.

In a fully open position (as shown in FIG. 6A), the first valve body 128*a* is spaced away from the first valve seat 126*a* by a first distance D1. The second valve body 128*b* is spaced away from the second valve seat 126*b* by a distance that is the sum of the first distance D1 and a second distance D2. The third valve body 128*c* is spaced away from the third valve seat 126*c* by a distance that is the sum of the first distance D1, the second distance D2 and a third distance D3. In other words, the spacing of the first, second, and third valve bodies 128*a*, 128*b*, 128*c* and valve seats 126*a*, 126*b*, and 126*c*, respectively may be expressed as follows:

$$D1<D1+D2<D1+D2+D3$$

The noise attenuation device 122 also includes a plurality of springs connected to the wire 130 and in series with the first, second and third valve bodies 128*a*, 128*b*, and 128*c*. More specifically, disposed between the first valve body 128*a* and the closed end 132 of the quarter-wave tube 124 is a first spring 140*a*. A second spring 140*b* is disposed between the first valve seat 126*a* and the second valve body 128*b*. A third spring 140*c* is disposed between the second valve seat 126*b* and the third valve body 128*c*.

Each of the first, second and third springs 140*a*, 140*b*, 140*c* have different spring constants. With this arrangement, the springs will deflect at different tensions placed on the wire 130. More specifically, the first spring 140*a* has a first spring constant k1. The second spring 140*b* has a second spring constant that is greater than the first spring constant k2. The third spring 140*c* has a third spring constant that is greater than the second spring constant k3. With this arrangement, the second and third springs 140*b*, 140*c* will bias the second and third valve bodies 128*b* and 128*c* away from the valve seats 126*b* and 126*c*, respectively, when the first valve body 128*a* is initially engaged with the first valve seat 126*a*, as shown in FIG. 6B, for example. Similarly, referring to FIG. 6C, when the first and second valve bodies 128*a*, 128*b* are engaged with the first and second valve seats 126*a*, 126*b*, respectively, the third spring 140*c* will bias the third valve body 128*c* away from the third valve seat 126*c* until the biasing force of the third spring 140*c* is overcome by the take-up mechanism 136. The relationship of the spring constants for the first, second and third springs 140*a*, 140*b*, and 140*c*, respectively, can be expressed as follows:

$$k1<k2<k3$$

In operation, with the engine 10 either not operating, or operating at a low operational condition (for example, idling), the take-up mechanism 136 is configured to be deactivated, such that the wire 130 and the springs 140*a*-140*c*, will serve to bias the valve bodes 128*a*-128*c* away from the respective valve seats 126*a*-126*c*. In this manner, the overall length of the quarter-wave tube 124 is equal to a first effective length QW1 of the quarter-wave tube 124 (best seen in FIG. 6A). At the first effective length QW1, the noise attenuation element 122 will attenuate noise at a first predetermined frequency level. It will be appreciated that the first predetermined frequency level can be determined based on the known geometry of the quarter-wave tube 124. However, with engagement of the first, second and third valve bodies, 128*a*, 128*b* and 128*c* with their respective valve seats 126*a*, 126*b* and 126*c*, the effective length of the noise attenuation element 122 can be selectively reduced to second, third and fourth effective lengths, QW2-QW4, as demonstrated in FIGS. 6B-6D, respectively. As may be seen, the second effective length QW2 is less than the third effective length QW3, and the fourth effective length QW4 is less than the third effective length. With this configuration, low frequencies can be attenuated at the first effective length QW1, while successively the higher frequencies can be attenuated at the second, third and fourth effective lengths QW2-QW4, as will be explained in further detail below. With this arrangement, the noise attenuation device 122 may be selectively controlled to attenuate at variable frequencies, but only using a single quarter-wave tube 124, thereby without any need for additional packaging space.

When the engine 10 operational conditions change that trigger a change in noise frequency level within a certain threshold range, one or more signals received by the controller C can cause the motor 138 to activate the take-up mechanism 136 to adjust the effective length of the quarter-wave tube 124. Referring to FIG. 5, exemplary sensors that are configured to detect operating conditions include, but are not limited to, a vehicle speed sensor 202, a mass air flow sensor 204, an accelerator pedal position sensor 206, and a throttle body position sensor 208. Sensors 202, 204, 206 and 208 are in communication with the controller C. When the operating condition reaches a certain threshold range that requires a specific effect length associated with desired frequency attenuation, the controller C will activate the motor 138 to activate the take-up mechanism 136 to selectively adjust the effective length of the quarter-wave tube 124.

FIGS. 6A-6D demonstrate how the effective length of the quarter-wave tube 124 can be selectively varied to attenuate different frequencies. More specifically, FIG. 6A illustrates the noise attenuation element 122 with all of the valve elements fully open, such that the first effective length QW1 is equal to the overall length of the quarter-wave tube 124. In FIG. 6B, in response to a signal from the controller C, the motor 138 activates the take-up mechanism 136 to initially reduce the quarter-wave tube 124 to the second effective length QW2. More specifically, the distance D1 between the first valve body 128*a* and the first valve seat 126*a*, is less than the corresponding distances for the second and third valve bodies 128*b*, 128*c* and second and third valve seats 126*b*, 126*c*. Further, the spring constant for the first spring 140*a* is less than the spring constants for the second and third springs 140*b*, 140*c*. With this arrangement, when the wire 130 is initially retracted by the take-up mechanism, the first spring 140*a* begins to deflect, i.e, the biasing force that moves the valve body 128*a* away from the valve seat 126*a* is overcome. While the deflection of the first spring 140*a* is occurring, the second and third springs 140*b* and 140*c* act like rigid bodies. It is not until the first valve body 128*a* engages with the first valve seat 126*a*, thereby defining the second effective length QW2 of the quarter-wave tube 124, that the second spring 140*b* can begin to deflect.

Figure 7:
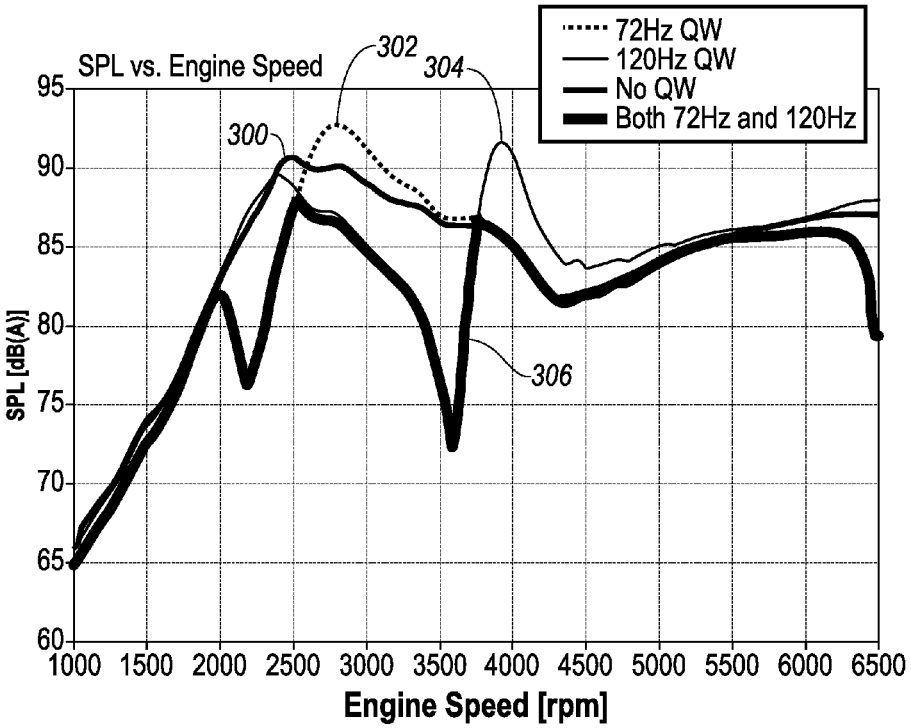
FIG. 7 is a graph illustrating a comparison of sound pressure levels at various engine speeds that may be achieved without a quarter-wave resonator, with separate quarter-wave fixed length resonators tuned to 72 Hz and 120 z frequencies, respectively, and an exemplary arrangement of the noise attenuation element of FIG. 5.

The effectiveness of the noise attenuation elements 22 and 122 will now be discussed in reference to the graphs in FIGS. 7 and 8. FIG. 7 illustrates the attenuation characteristics without a quarter-wave resonator, with separate 72 Hz and 120 Hz fixed volume quarter-wave resonators, and with a variable quarter-wave resonator such as that shown in either FIG. 1 or FIG. 5 (selectively adjustable between 72 Hz and 120 Hz). More specifically, curve 300 illustrates the sound pressure level (SPL) in decibels without a resonator. Curve 302 illustrates the SPL with a fixed volume 72 Hz resonator. Curve 304 illustrates the SPL with a fixed volume 120 Hz resonator. Curve 306 illustrates the SPL with a noise attenuation device 22 or 122, that has been tuned to 72 Hz and 120 Hz respectively.

Without any resonator, curve 300 demonstrates that the SPL peaks at approximately 91 decibels, at an engine speed of approximately 2500 rpms. However, both curves 302 and 304 exhibit large side band amplification that even exceeds the SPL peak of curve 300. For example, curve 302 peaks at approximately 93 decibels, while curve 304 peaks at approximately 92 decibels. In contrast, use of an exemplary arrangement of noise attenuation device 22 or 122 that can be tuned at predetermined engine speeds, may effectively eliminate such side bands. For example, curve 306 peaks well below curves 300, 302 and 304 and exhibit no side band amplification.

Figure 8:
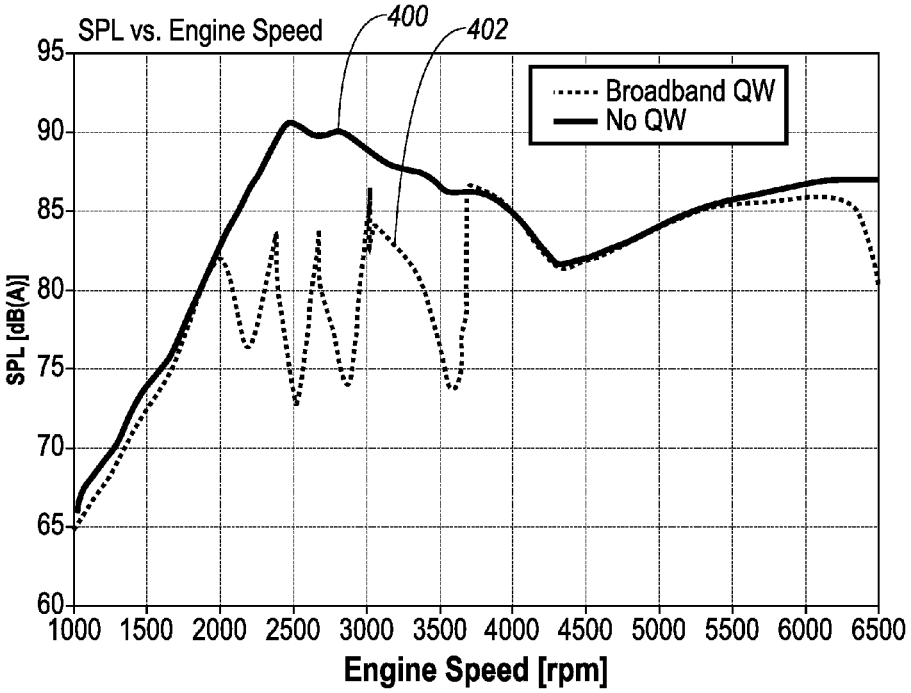
FIG. 8 is a graph illustrating sound pressure levels at various engine speeds that may be achieved with another exemplary arrangement of the noise attenuation element of FIG. 5, and without a quarter-wave resonator.

FIG. 8 demonstrates the attenuation characteristics without a quarter-wave resonator as compared with an embodiment of noise attenuation device 122 that has been tuned to 72 Hz (FIG. 6A), 84 Hz (FIG. 6B), 96 Hz (FIG. 6C), and 120 Hz (FIG. 6D). Curve 400 represents illustrates the SPL in decibels without a resonator. Curve 402 illustrates the SPL with the noise attenuation device 122. The noise attenuation device 122 serves to significantly reduce SPL. Further, as may be seen in the right of FIG. 8, the noise attenuation device 122 exhibits a second harmonic of the 72 Hz level at 218 Hz. Thus, the 4 different settings of the noise attenuation device 122 shown in FIGS. 6A-6D, is capable of yielding attenuation at 5 different frequencies. Thus the noise attenuation device 122 can be utilized to attenuate higher frequencies, as a quarter-wave tube 124 tuned below 100 Hz will attenuate 2 additional frequencies below 1000 Hz.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A noise attenuation element for vehicles, comprising:
a tube having an overall length;
a valve seat disposed in the tube;
a valve body; and
a wire fixed to an interior closed end of the tube and connected to the valve body, wherein retraction of the wire moves the valve body axially within the tube into sealed engagement with the valve seat defining a tube effective length that is less than the overall length.

2. The noise attenuation element of claim 1, wherein the wire is operably connected to a take-up mechanism, and wherein activation of the take-up mechanism retracts the wire through the tube.

3. The noise attenuation element of claim 2, further comprising a motor that is connected to the take-up mechanism and a controller, wherein the controller actuates the motor to activate the take-up mechanism in response to operational parameters of an engine.

4. The noise attenuation element of claim 1, wherein the wire further comprises a spring connected to the wire.

5. The noise attenuation element of claim 4, wherein the spring is disposed between the valve body and the closed end of the tube.

6. The noise attenuation element of claim 1, wherein the valve seat is positioned at a predetermined location to define an attenuation frequency when the valve body is engaged with the valve seat.

7. A noise attenuation element for vehicles, comprising:
a tube having an overall length that defines a first effective length;
a first valve seat disposed in the tube;
a first valve body disposed in the tube and selectively engageable with the first valve seat;
a second valve seat disposed in the tube;
a second valve body disposed in the tube and selectively engageable with the second valve seat;
a wire having a first end fixed to an interior closed end of the tube and connected to the first and second valve bodies, and
first and second springs connected to the wire, wherein the first spring is disposed between the first end of the wire and the first valve body and wherein the second spring is disposed between the first valve seat and the second valve body; and
wherein an initial retraction of the wire serves to deflect the first spring and selectively move the first valve body axially within the tube to bring the first valve body into engagement with the first valve seat, to selectively define a second effective length of the tube that is less than the first effective length.

8. The noise attenuation element of claim 7, wherein when the wire is in a non-retracted position whereby the tube has the first effective length, the first valve body is spaced from the first valve seat by a first distance, and the second valve body is spaced from the second valve seat by a sum of the first distance and a second distance.

9. The noise attenuation element of claim 8, wherein the first spring has a first spring constant that is different than a second spring constant of the second spring.

10. The noise attenuation element of claim 9, wherein the first spring constant is less than the second spring constant.

11. The noise attenuation element of claim 7, wherein the wire is operably connected to a take-up mechanism, and wherein activation of the take-up mechanism retracts the wire.

12. The noise attenuation element of claim 11, further comprising a motor that is connected to the take-up mechanism and a controller, wherein the controller actuates the motor to activate the take-up mechanism in response to an operational condition of an engine.

13. The noise attenuation element of claim 12, further comprising at least one operational condition sensor in communication with the controller.

14. The noise attenuation element of claim 13, wherein the least one operational condition sensor is one of a vehicle speed sensor, a mass air flow sensor, an accelerator pedal position sensor, and a throttle body position sensor.

15. The noise attenuation element of claim 7, wherein continued retraction of the wire after the first valve body engages with the first valve seat serves to deflect the second spring and selectively bring the second valve body into engagement with the second valve seat, to selectively define a third effective length of the tube that is less than the second effective length.

16. The noise attenuation element of claim 15, further comprising a third valve seat disposed in the tube, a third valve body selectively engageable with the third valve seat; and a third spring, wherein the third spring is disposed between the second valve seat and the third valve body.

17. The noise attenuation element of claim 16, wherein continued retraction of the wire after the second valve body engages with the second valve seat serves to deflect the third spring and selectively bring the third valve body into engagement with the third valve seat, to selectively define a fourth effective length of the tube that is less than the second effective length.

* * * * *